United States Patent [19]

Kondo

[11] 4,400,206

[45] Aug. 23, 1983

[54] PROCESS FOR ESTIMATING PARTICLE SIZE SEGREGATION OF BURDEN LAYER IN BLAST FURNACE TOP

[75] Inventor: Mikio Kondo, Chiba, Japan

[73] Assignee: Kawasaki Steel Corporation, Kobe, Japan

[21] Appl. No.: 268,016

[22] Filed: May 28, 1981

[51] Int. Cl.[3] ..... C21B 5/00

[52] U.S. Cl. ..... 75/41

[58] Field of Search ..... 75/41

[56] References Cited

FOREIGN PATENT DOCUMENTS 55-62106 5/1980 Japan ..... 75/41

*Primary Examiner*—P. D. Rosenberg

*Attorney, Agent, or Firm*—Balogh, Osann, Kramer, Dvorak, Genova & Traub

[57] ABSTRACT

A process for estimating a particle size segregation in a burden layer at a blast furnace top is disclosed, which comprises measuring a particle size distribution of a burden material before the charging and a layer thickness distribution of the burden layer after the charging, and estimating a particle size distribution at every position in the burden layer charged at the furnace top on the basis of the above measured values, charging conditions and furnace operating conditions according to a simulation model of particle size segregation.

1 Claim, 4 Drawing Figures

PROCESS FOR ESTIMATING PARTICLE SIZE SEGREGATION OF BURDEN LAYER IN BLAST FURNACE TOP

This invention relates to a process for estimating a state of a particle size segregation in a burden layer at a top portion of a blast furnace, and more particularly to a process for estimating a particle size distribution of a burden layer charged in the top portion of the blast furnace at each position toward the radial direction of the furnace throat from the particle size distribution of the burden material before the charging, the charging conditions and the furnace operating conditions according to a particle size segregation model.

In order to achieve the reduction of fuel rate and the stabilization of blast furnace operation, it is important to optimize a radial distribution of gas flow in the furnace by controlling the burden distribution in the furnace top portion. The term "burden distribution in the furnace top portion" used herein mainly means a layer thickness distribution for ore layer and coke layer and a particle size distribution in each layer. In general, the gas flow in the furnace is distributed according to the radial distribution of gas flow resistance of the burden layer, which is determined from the layer thickness distribution and particle size distribution, so that it is necessary to know both the distributions. In this connection, there are many measurements for the layer thickness distribution, but no means actually measuring and estimating the particle size distribution have been developed.

In general, the burden distribution at the top of the blast furnace are influenced by various factors complicatedly entangled with each other. The main factors are as follows:

(1) Physical properties of burden material such as density, particle size, coefficient of internal friction and so on;
(2) Charging speed;
(3) Charging conditions such as coke base, ore/coke ratio (hereinafter referred to as O/C), stock line level and so on;
(4) Falling trajectory of burden flow, which fundamentally depends on a notch position of a movable armor in a bell-type blast furnace or a tilting angle of a distributing chute in a bell-less top blast furnace;
(5) Charging sequence; and
(6) Gas flow rate in the furnace.

Besides, a geometrical arrangement between the throat of the furnace and the charging equipment is considered to be one of the fundamental factors in the formation of burden distribution, but it is not an operational factor in the specified blast furnace. Therefore, when the burden is charged into the specified blast furnace through the specified charging equipment, the burden distribution is determined under an influence of the above mentioned factors. Particularly, layer thickness distribution and particle size distribution of the burden in the radial direction of the furnace are significant in order to achieve the reduction of fuel rate and the stabilization of furnace operation.

In the conventional operation of blast furnaces, the concept for controlling the burden distribution is based on the control of the layer thickness distribution and lies in optimizing the radial distribution of the thickness ratio of ore layer to coke layer ($L_o/L_c$) or of O/C explained by a product of this ratio with a bulk density ratio ($\rho_o/\rho_c$). For instance, it is experimentally known that when the horizontally sectional area of the throat in the blast furnace is equally divided into a central part (C), a middle part (M) and a peripheral part (P), if the relation of the layer thickness ratio ($L_o/L_c$) in these parts is given by the following equation (1):

$$(L_o/L_c)_M > (L_o/L_c)_P > (L_o/L_c)_C \quad (1),$$

the stable operation with low fuel rate can be achieved. However, the control of burden distribution aims at optimizing the radial distribution of gas flow resistance of burden layer and radial gas flow distribution accompanied therewith. For this purpose, there must be known the particle size distribution of burden material at each position in the radial direction of the furnace in addition to the above layer thickness distribution. The thickness of the burden layer can be measured directly or indirectly. The techniques of direct measurement are based on the use of an electrode or a magnetic censor. The indirect method is based on the procedure of determining the layer thickness from the difference of the burden surface level measured before and after charging the said burden materials by means of a transversely movable sounding device or microwave device or a layer-measuring system. On the other hand, a method of measurement of particle size distribution is not established at all because the quantity required for exactly determining the particle size distribution of the burden cannot be sampled from the inclined burden surface at given local positions in the radial direction of the operating furnace. In order to optimize the gas flow distribution in the blast furnace, it is essential and important to know the particle size distribution of the burden at given positions in the radial direction of the furnace.

With the foregoing in mind, the inventor has made various studies and experiments and as a result, the invention has been accomplished.

According to the invention, there is the provision of a process for estimating a particle size segregation in a burden layer stacked at a top portion of a blast furnace, which comprises measuring a particle size distribution of a burden material before the charging and a layer thickness distribution of said burden layer after the charging, and estimating a particle size distribution at every position in said burden layer charged at the furnace top on the basis of said measured values, charging conditions and furnace operating conditions according to a simulation model of particle size segregation given by the following equation:

$$\log\{X_n/(1-X_n)\} = -\alpha \cdot l + \log\{X_n^o/1-X_n^o)\}$$

wherein $X_n$ is a cumulative weight fraction of particles having smaller size than n-th sieve opening, $\alpha$ is a size segregation constant and l is a distance from a collision point of main falling trajectory against burden surface to the flowing direction, that is, to center and to the wall. The suffix 'o' means the value of $X_n$ at l=o.

The invention will now be described in detail with reference to the accompanying drawings, wherein.

Figure 1:
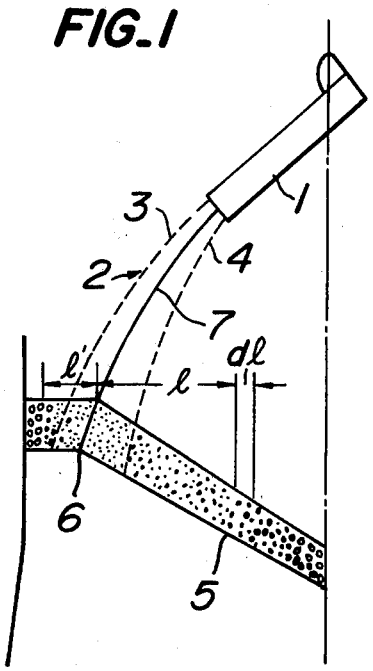
FIG. 1 is a diagrammatical view illustrating a particle size distribution in a burden layer stacked at a top portion of a blast furnace.

In FIG. 1 is schematically shown a state of particle size segregation in a burden layer stacked upwardly at a top portion of a blast furnace. A burden flow 2 discharged from a charging equipment 1 falls in a spaced bordered with an upper side 3 and a lower side 4 of a falling trajectory and comes into collision with a previously charged burden 5 to stack it thereon. In this case, when the profile of burden distribution as shown in FIG. 1 is M-shape, the burden flow is divided at a position of peak 6 appeared in the burden distribution into a stream directing to the center of the furnace and a stream directing to the wall of the furnace. With the advance of the stacking, the position of peak 6 is shifted upward along a main falling trajectory 7 of the burden flow as shown in FIG. 1. The main trajectory 7 is regarded as the curve passing through the points inside the burden flow 2, at which the cumulative weight fraction of burden materials integrated in a certain hortizontal plane from the upper side of the falling burden flow toward the lower side reaches 50%. When each of the two streams directing to the furnace center and furnace wall flows with a certain layer thickness, a void between large-size particles plays the same role as a sieve opening in the sieving operation. Under such a role of the void, small-size particles in the burden material is percolated into a lower-side portion having a small flow rate and then left in a portion near the falling point as they are, while large-size particles go on rolling toward the furnace center downward. As a result, the particle size in case of the M-shape profile is maximum at the central part of the furnace, and becomes smaller toward the furnace wall, and is minimum near the collision portion of the burden flow against the previously charged burden. When the profile of burden distribution is V-shape, there is obtained such a particle size segregation that the particle size gradually increases in a direction of from the furnace wall to the furnace center.

Now, such a phenomenon of particle size segregation in the radial direction of the furnace may be simulated by an equation as expressed below. When a horizontal distance from the position of peak or the collision point (R*) of main falling trajectory against burden surface to an optional downstream point is l (m) and the cumulative weight fraction of particles having smaller size than n-th sieve opening is $X_n$, if the burden stream flows from l to l+dl, a percolation rate of particles having the above mentioned particle size ($-dX_n/dl$) is given by the following equation (2), as a result of investigations by the inventor.

$$-dX_n/dl=\alpha\cdot X_n\cdot(1-X_n) \tag{2}$$

That is, the equation (2) means that the percolation rate of fine particles is proportional not only to the weight fraction of fine particles but also a weight fraction of coarse particles acting as a sieve in the percolation. In this equation, $\alpha$ is a constant indicating a degree of particle size segregation in the flowing direction of the burden, which is called as a size segregation constant. The value of $\alpha$ depends upon the properties of the burden material, charging speed and gas flow velocity in the furnace and the like.

The integration of equation (2) gives the following equation (3):

$$\log\{X_n/(1-X_n)\}=-\alpha\cdot l+\log\{X_n^o/1-X_n^o)\} \tag{3}$$

In the equation (3), the second term on the right-hand side means the value of $\{X_n/(1-X_n\}$ at l=0. That is, the equation (3) is a simulation model of particle size segregation for a particle size distribution of the burden layer charged at every position of the furnace top toward the radial direction of the furnace.

In order to estimate $X_n$ (i.e. cumulative weight fraction of particles having smaller size than n-th sieve opening) at every position in the radial direction, the value of the second term on the right hand side of the equation (3) must first be determined, which may be given as follows. That is, the averaged value of cumulative weight fraction of particles having a particle size smaller than n-th sieve opening, which are distributed radially from the furnace center to the furnace wall, should be equal to a value $X_n^f$ of the burden material before the charging. Assuming that the bulk density of the burden layer is constant at each position, $X_n^o$ is strictly given by the following equation (4):

$$\int_o^{R-R^*}\frac{X_n^o\cdot e^{-\beta l'}}{1-X_n^o(1-e^{-\beta l'})}\cdot h(R^*+l')\cdot(R^*+l')dl' - \int_o^{R^*}\frac{X_n^o\cdot e^{-\alpha l}}{1-X_n^o(1-e^{-\alpha l})}\cdot h(R^*-l)\cdot(R^*-l)dl = X_n^f\cdot\int_o^R r\cdot h(r)dr \tag{4}$$

wherein $\alpha$ is a size segregation constant at r=o~R*, $\beta$ is a size segregation constant at r=R*~R, r is a distance from the furnace center, h(r) is a function indicating the layer thickness distribution and requires a found value, R is a radius of the furnace throat, and R* is a radial position from the furnace center at l=0 and corresponds to a collision point of the main falling trajectory against the previously charged burden. In order to obtain the value of R*, it is necessary to measure the profile of burden distribution.

The equation (4) means that an average value derived from the integration of the equation (3) between the furnace center and the furnace wall is equal to the value before the charging. Therefore, the particle size distribution at l=0, i.e. the value of the second term on the right-hand side of the equation (3) is calculated from the equation (4) considering the found values for the particle size distribution $X_n^f$ before the charging and the layer thickness distribution h(r) as well as the position R* of peak of the burden distribution profile, so that the particle size distribution at an optional distance l can be arithmetically estimated by the equation (3).

As apparent from the equation (4), the value of $X_n^o$ cannot be calculated explicitly. Now, by using the assumed $X_n^o$, the integration on the right hand side of the equation (4) is first performed and then the value of $X_n^o$ satisfying the equation (4) must be determined by trial and error method, which can easily be performed by means of an electronic computer.

The equation (4) gives a strick value of $X_n^o$, but if this value is accepted to have an error of few percents, $X_n^o$ can be estimated by the following equation (5):

$$\frac{X_n^o/(1-X_n^o)}{X_n^f/(1-X_n^f)} = \frac{\int_o^R r \cdot h(r)dr}{\int_o^{R-R^*} (R^*+l') \cdot h(R^*+l') \cdot e^{-\beta l'}dl' - \int_o^R (R^*-l) \cdot h(R^*-l)e^{-\alpha l}dl} \quad (5)$$

By using the equation (5), the calculation can somewhat be simplified because it is not necessary to perform the trial and error method as in the equation (4).

In the actual operation, the particle size segregation constant $\alpha$ of the equation (3) must first be determined. In this case, the burden material in an actual or laboratory furnace are sampled at two positions spaced only by a distance $\Delta l$(m) in the radial direction of the burden level in the furnace. Then, the particle size analysis for the two samples is performed to determine a difference $\Delta\log\{X_n/(1-X_n)\}$ between two positions, from which $\alpha$ is calculated according to the equation (6) as follows:

$$\alpha = -\frac{\Delta\log\{X_n/(1-X_n)\}}{\Delta l} \quad (6)$$

Moreover, when the sampling of the burden material is carried out at three or more positions, $\alpha$ and $\log\{X_n^o/(1-X_n^o)\}$ are calculated by the least squares method using the equation (3).

Then, there was made a comparison between the found value and the estimated value for particle size distribution in burden layer at every position toward radial direction according to the process of the invention to obtain a result as shown in the following Table 1.

TABLE 1

| | | Weight fraction of each particle size $X_n$ (%) Distance from furnace center in radial direction | | | | | | | | Weight fraction |
|---|---|---|---|---|---|---|---|---|---|---|
| | | 4.62 m | | 4.0 m | | 3.0 m | | 2.0 m | | |
| n | Particle size (mm) | Found value | Estimated value | Found value | Estimated value | Found value | Estimated value | Found value | Estimated value | before the charging $X_n^f$ (%) |
| 1 | 0-5 | 22.8 | 22.2 | 17.3 | 15.4 | 7.9 | 8.1 | 5.1 | 4.1 | 15.9 |
| 2 | 5-7.5 | 23.5 | 17.7 | 38.2 | 33.7 | 28.4 | 24.7 | 19.1 | 14.4 | 28.3 |
| 3 | 7.5-9.5 | 9.7 | 9.4 | 15.3 | 15.8 | 18.2 | 14.5 | 12.9 | 11.8 | 14.2 |
| 4 | 9.5-13.5 | 19.3 | 20.8 | 18.2 | 20.7 | 27.0 | 26.9 | 26.8 | 28.0 | 22.1 |
| 5 | 13.5-18.5 | 17.5 | 20.0 | 7.8 | 10.1 | 12.5 | 17.3 | 24.0 | 25.6 | 13.6 |
| 6 | 18.5-26.0 | 6.4 | 8.4 | 2.5 | 3.3 | 3.8 | 6.4 | 10.2 | 12.0 | 4.6 |
| 7 | 26.0-36.0 | 0.5 | 0.7 | 0.4 | 0.5 | 0.8 | 1.1 | 1.2 | 2.0 | 0.6 |
| 8 | 36.0-50.0 | 0.3 | 0.8 | 0.1 | 0.5 | 0.2 | 0.5 | 0.3 | 1.4 | 0.2 |
| 9 | 50.0-65.0 | 0 | 0 | 0 | 0 | 1.1 | 0.5 | 0.4 | 0.7 | 0.5 |
| | Average particle size | 9.4 | 10.3 | 8.0 | 8.7 | 10.2 | 10.9 | 12.1 | 13.4 | 9.4 |

Figure 2:
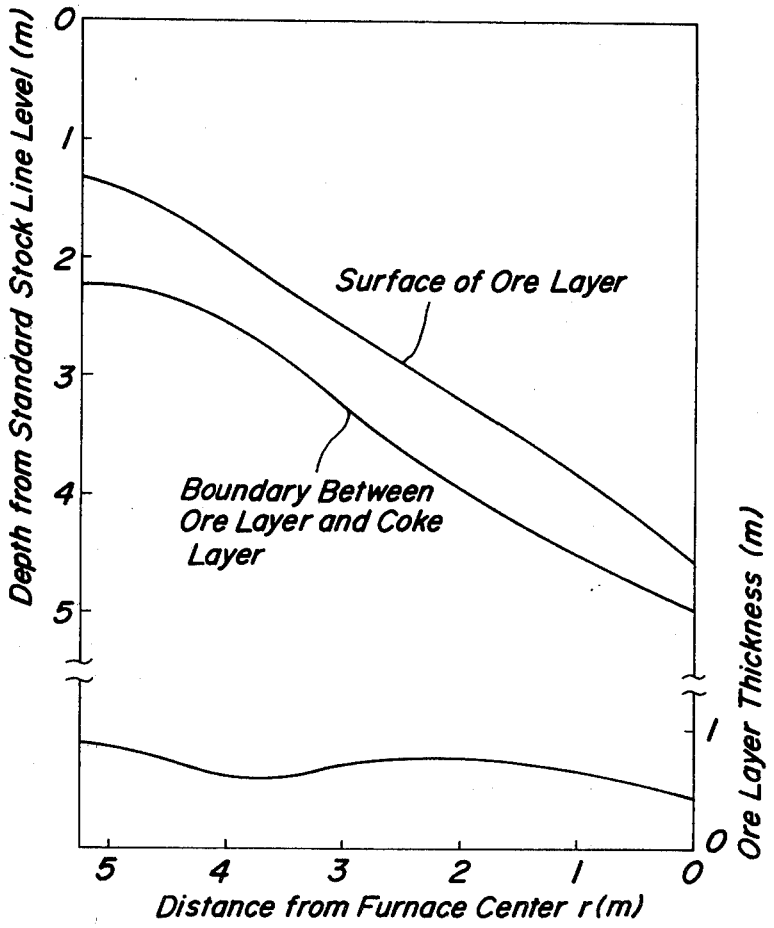
FIG. 2 is a diagram illustrating an embodiment of actually measured value for ore layer thickness.

In the blast furnace with the throat radius of 5.25 m, the boundary between ore layer and coke layer and the surface of ore layer were measured by means of a layer thickness measuring device utilizing the electrodes. Both radial profiles are shown in FIG. 2. And also, the ore layer thickness h(r) was obtained from the difference of both the levels of radial profile as shown in FIG. 2.

Figure 3:
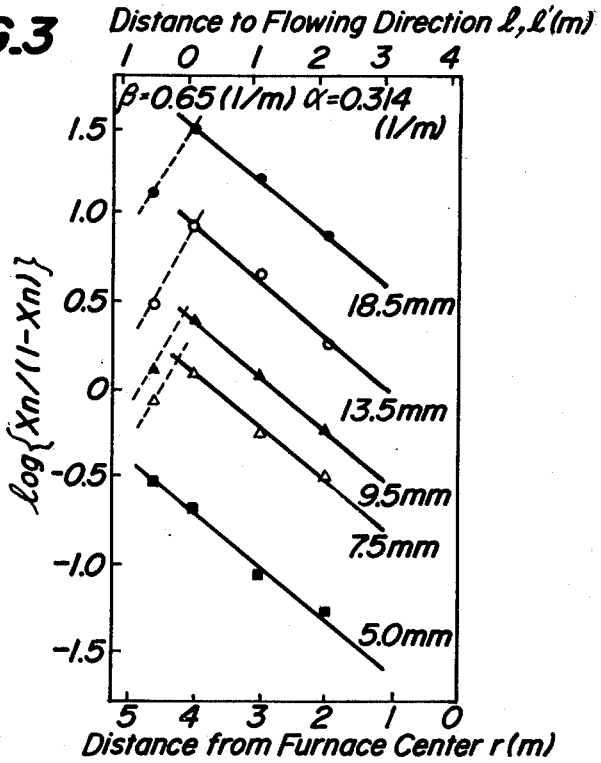
FIG. 3 is a graph showing a relation between $\log\{X_n/(1-X_n)\}$ and the distance from the furnace center or the distance from the collision point of main falling trajectory against the burden surface to the flowing direction.

The particle size analysis was made with respect to four samples of the ore layer, each of which being sampled at a distance of 2.0, 3.0, 4.0 or 4.62 m from the furnace center, to obtain a result as shown in a column "Found value" of Table 1. From these found values is obtained $\log\{X_n/(1-X_n)\}$, which is plotted in FIG. 3 with respect to the radial position. As a result, R* is 4 m, $\alpha$ is 0.314 (1/m) on the average and $\beta$ is 0.65 (1/m). In this case, the reason why the average value of 0.314 is selected as $\alpha$ value is due to the face that the $\alpha$ value is 0.310, 0.314, 0.308, 0.317 and 0.321 for $X_1$, $X_2$, $X_3$, $X_4$ and $X_5$, respectively, which means that these $\alpha$ values are not substantially dependent upon the particle size.

Further, the particle size distribution of ore before the charging $X_n^f$(%) is shown in the most right-hand column of Table 1. On the other hand, the particle size distribution at a distance of 2.0, 3.0, 4.0 or 4.62 m from the furnace center is estimated according to the equations (3) and (5) using the above mentioned values and also shown in a column "Estimated value" of Table 1.

As apparent from Table 1, the estimated value is well coincident with the found value, which proves that the particle size distribution in the burden layer at every position in the radial direction is adequately estimated by the process according to the invention.

Although this example shows the case that the value of $\alpha$ is not dependent upon the particle size and is substantially constant, the invention is applicable without troubles even when the $\alpha$ value varies with the particle size.

Figure 4:
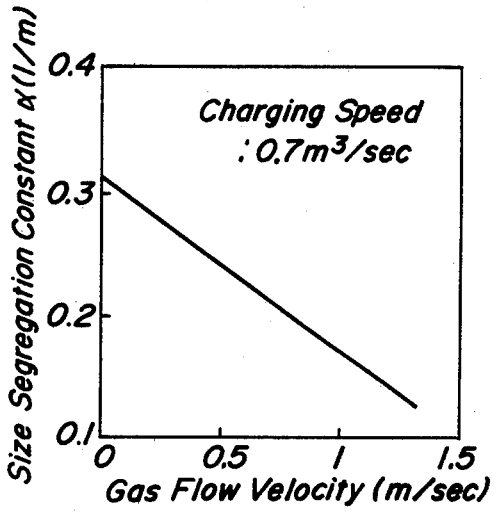
FIG. 4 is a graph showing a relation between the gas flow rate and the size segregation constant.

According to the invention, the operation of determining the size segregation constant by sampling the burden material may be omitted by measuring beforehand a relationship between the size segregation constant and each factor influencing thereupon. For instance, a relation between the size segregation constant and the gas flow velocity in a bell-less top blast furnace is shown in FIG. 4, wherein the charging speed of the burden material is 0.7 $m^3$/sec. As apparent from FIG. 4, the flowing rate of the burden material on the old burden surface toward the furnace center or wall becomes higher with the increase in gas flow velocity, so that the degree of size segregation becomes smaller. Thus, sich a relation is sufficient to be measured beforehand in each of blast furnaces under various conditions.

In this way, the invention first makes possible not only to estimate a particle size segregation state of a burden layer in the top portion of the blast furnace, but also to quantitatively examine a charging method for optimizing the burden distribution inclusive of layer thickness distribution and particle size distribution. In the latter case, the burden distribution can be controlled so as to always hold at an optimum state, so that the reduction of fuel rate and the stabilization of furnace operation can effectively be achieved in the blast furnace.

Moreover, a fundamental physical phenomenon aiming at the invention consists in the particle size segregation of the burden layer toward the flowing direction on the inclined burden surface. Similarly, such a phenomenon occurs in the supply of particulate matters, granules or the like into a storing apparatus, reaction vessel or the like. In iron-making process, there are (a) particle size segregation in the layer thickness direction during the supply of raw material onto a pallet for sintering, (b) particle size segregation in radial direction of a banker for raw sintering material or an ore stock yard, the the like. In any case, the estimation according to the invention can be applied to such particle size segregation phenomena.

What is claimed is:

1. A process for estimating a particle size segregation in a burden lyer stacked upwardly in a blast furnace, which comprises measuring a particle size distribution of a burden material before charging the burden material into the furnace to form a burden layer therein and measuring a layer thickness distribution of said burden layer after the charging of the burden material into the furnace, and estimating a particle size distribution at every position in said burden layer on the basis of said measured values, charging conditions and furnace operating conditions according to a simulation model of particle size segregation given by the following equation:

$$X_n = \frac{X^{\circ}_n e^{-\alpha l}}{1 - X^{\circ}_n (1 - e^{-\alpha l})}$$

wherein $X_n$ is a cumulative weight fraction of particles having smaller size than n-th sieve opening, $\alpha$ is a particle size segregation constant, and l is a distance from a collision point of main falling trajectory against burden surface, to the flowing direction.

* * * * *